United States Patent [19]

Craig

[11] Patent Number: 4,749,304

[45] Date of Patent: Jun. 7, 1988

[54] VARIABLE WIDTH MATERIAL DISTRIBUTION SYSTEM FOR ASPHALT PAVERS AND THE LIKE

[75] Inventor: Andrew E. Craig, Shelbyville, Ill.

[73] Assignee: White Consolidated Industries, Inc., Cleveland, Ohio

[21] Appl. No.: 907,655

[22] Filed: Sep. 15, 1986

[51] Int. Cl.[4] ..... E01C 19/48

[52] U.S. Cl. ..... 404/101; 404/108

[58] Field of Search ..... 404/101, 105, 106, 102, 404/104, 96; 198/660

[56] References Cited

U.S. PATENT DOCUMENTS

| | | | |
|---|---|---|---|
| 2,309,418 | 1/1943 | Schweickart et al. | 198/631 |
| 2,589,256 | 3/1952 | Horning | 404/101 X |
| 2,845,167 | 7/1958 | Heiken | 198/660 |
| 3,015,258 | 1/1962 | Apel et al. | 404/106 |
| 3,130,654 | 4/1964 | Apel et al. | 404/105 X |
| 3,605,995 | 9/1971 | Maack | 198/660 |
| 3,907,451 | 9/1975 | Fisher et al. | 404/101 |
| 4,342,162 | 8/1982 | Spaans et al. | 404/101 |

FOREIGN PATENT DOCUMENTS

| | | | |
|---|---|---|---|
| 1092944 | 7/1957 | Fed. Rep. of Germany | 404/118 |
| 727533 | 4/1980 | U.S.S.R. | 198/660 |

*Primary Examiner*—James A. Leppink
*Assistant Examiner*—Matthew Smith
*Attorney, Agent, or Firm*—Schweitzer & Cornman

[57] ABSTRACT

An asphalt paver, of the type having a power extendable floating screed, is provided with a power extendable auger-like material distribution mechanism, such that the width of the distribution mechanism can be varied with the width of the screed. The variable width distribution mechanism is structurally independent of the floating screed, so as not to impart its reaction forces to the screed.

A variable width panel arrangement is incorporated into the power extendable distribution mechanism and is extendable and retractable along with the latter to provide for proper confinement of the paving material during lateral distribution.

26 Claims, 6 Drawing Sheets

VARIABLE WIDTH MATERIAL DISTRIBUTION SYSTEM FOR ASPHALT PAVERS AND THE LIKE

BACKGROUND AND SUMMARY OF THE INVENTION

In the laying of asphalt pavement roadways, for example, it is common to utilize floating screed type pavers. In pavers of this type, a paver tractor is advanced along the roadbed, typically pushing ahead of it a truck containing a supply of hot asphalt. The hot asphalt material is conveyed to the back of the paver, by internal conveyor means, and deposited in front of the floating screed. The paving material is distributed in front of the screed, and then leveled and smoothed by the advancing screed, as it travels over the just deposited asphalt material.

Inasmuch as the internal conveyor means of the paver is typically narrower in width than the screed, conventional floating screed pavers are provided with transversely disposed rotating auger-like distribution means, positioned directly in front of the screed. The auger-like means serve to move the deposited asphalt material laterally, and to distribute it with some degree of uniformity in front of the advancing screed. Ideally, the transverse width of the auger-like means is approximately the same as the width of the screed, in order to assure distribution of the paving material to the extremities of the screed.

In order to accommodate laying of pavement mats of different width, the design of conventional paving machines typically has provided for the use of extension attachments for both the screed and auger facilities. Thus, for over-the-road travel, either self-powered or by truck, the paver is configured for minimum width. At the job site, extension attachments are mounted to the screed and to the auger-like distributor, to increase the paving width of the machine to meet the demands of the job.

It has been known heretofore to construct a floating screed paver with a power extendable/retractable screed arrangement, enabling the operator of the paver to vary the effective width of the screed at any time, even while the paver is in motion and in operation. Originally, such power variable screed arrangements were utilized primarily in connection with special paving jobs, such as driveways, parking lots, etc. where considerable width variability might be expected. Increasingly, however, paving contractors are preferring power variable screed constructions even for extended highway paving, where there may be minimum variability in the width of the paving mat. Such power variable screed facilities provide the contractor with a great degree of flexibility, and also can result in considerable savings of set-up and knock-down time at the beginning and end of paving operations. An advantageous form of such power variable screed for an asphalt paver is described in the Robert L. Brown, U.S. Pat. No. 4,379,653, assigned to White Consolidated Industries, Inc., the disclosure of which is incorporated herein by reference.

One of the shortcomings of asphalt paving equipment utilizing any of the existing power variable screed arrangements is that the auger-like mechanisms, utilized for distributing the paving material across the full width of the screed, do not vary along with the adjustments in screed width. This can cause problems in the uniformity of the pavement mat, particularly near the outer extremities of an extended screed. One attempt to overcome problems of this type is reflected in the Fisher et al. U.S. Pat. No. 3,907,451, in which auger devices are mounted directly on a movable strike-off element such that, when the strike-off element is moved in a laterally outward direction, it carries the auger mechanism with it. This does little to solve the material distribution problem, however, because moving the augers in an outward direction leaves an area in the center, where the bulk of the material is being deposited, without means to move it laterally outward. Further, the mounting of an auger on a screed or strike-off element serves to impose widely varying reaction forces on the screed or strike-off element, which can have the effect of introducing undesirable variations in the finish of the pavement mat.

Pursuant to the present invention, a novel and improved material distribution arrangement is provided for an asphalt paving machine, particularly a machine equipped with a power variable floating screed, in which an auger-like distribution mechanism is of telescoping construction capable of expanding laterally, either along with or independently of the power extendable screed. The new arrangement represents a vast improvement in existing asphalt pavers with power variable screeds, in that under all conditions it is assured that there will be an effective distribution of the paving material laterally in front of the extended screed.

To advantage, the power extendable material distribution mechanism of the invention is mounted and supported on the paver tractor, independently of the floating screed, so that the action of the screed is not affectd by the variable reaction forces typically acting upon the distribution mechanism.

In a highly advantageous form, the power extendable distributor arrangement of the invention is comprised of telescopically associated auger-like sections, each containing a plurality of paddle-like deflector plate segments arranged to an angle to the rotational axis of the auger mechanism. When the mechanism is in its fully condensed or retracted position, the various deflector segments optimally may be aligned to form a more or less continuous helix, although that is not necessary to the invention. When extended or partially extended, the deflector segments are distributed over the full length of the device and act with a high degree of effectiveness on the deposited paving material to provide a desired degree of uniformity in the distribution thereof out to the farthest reaches of the extended screed.

Among other features of the invention, the power variable auger-like distributor mechanism of the invention is designed to be suitable for operation in the extremely hostile environment, such as that represented by hot asphalt material, in which the distributor mechanism is immersed or partially immersed during normal operations. Initially, the asphalt material is hot and plastic, but it accumulates and hardens over time, such that any mechanism operating in its environment must be rugged and dependable in construction, and have a measure of self-cleaning action to minimize the likelihood of the mechanism being "frozen" by congealed asphalt.

As a subsidiary feature, the apparatus of the invention incorporates an advantageous form of telescoping material confinement panel structure, positioned in front of the telescoping distributor mechanism and extendable or retractable along with it. The confinement panel works in cooperation with the screed to confine the deposited paving material, but in front of and behind the distributor mechanism, over its adjustably extended length. In addition, the panel structure serves as an extendable guard, so that workmen are fully protected from accidental contact with the rotating distributor plates.

For a more complete understanding of the above and other features and advantages of the invention, reference should be made to the following detailed description of preferred embodiments and to the accompanying drawing.

DESCRIPTION OF PREFERRED EMBODIMENTS OF THE INVENTION

Figure 1:
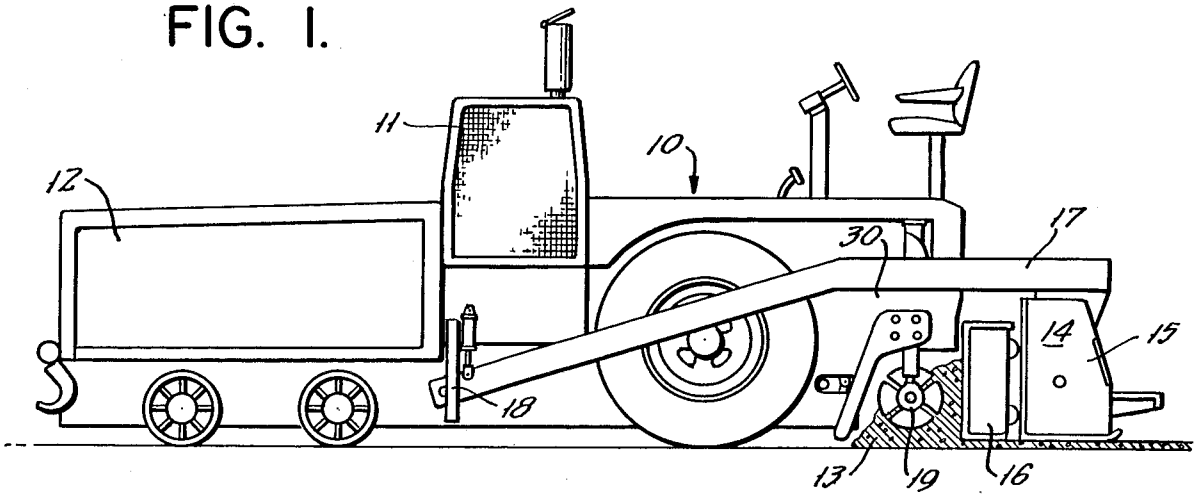
FIG. 1 is a side elevational view of a typical form of floating screed asphalt paver incorporating a power extendable material distributor mechanism according to the invention.

Referring now to the drawings, and initially to FIGS. 1–10 thereof, the reference numeral 10 designates generally a typical form of floating screed type asphalt paver in which the features of the invention are incorporated. The paver is self-powered by an engine 11 and has at its forward end a load carrying hopper 12 for receiving hot asphalt paving material from a dump truck positioned directly in front of the paver. In typical operation, the paver pushes the truck along the roadbed, with the truck continually discharging material into the hopper 12. When the truck is emptied, the paver continues paving, using the reserve of material contained in the hopper 12, while the new truck is brought into position in front of the paver.

A conventional paver includes internal conveyor means (not shown) which convey the hot asphalt material rearward, depositing it at the back of the paver tractor, as indicated at 13.

In the illustrated paver apparatus, a power extendable screed 14, comprising a center screed section 15 and opposite side, laterally extendable screed elements 16, is attached to the paver tractor by means of tow arms 17 at each side. The tow arms 17 are attached to the paver at tow points 18, which are vertically adjustable such that the angle of attach of the floating screed assembly 14 may be controllably varied during paving to maintain a level paving surface. The power extendable screed structure may be in accordance with the before mentioned Brown U.S. Pat. No. 4,379,653.

Directly in front of the screed assembly 14 is an auger-like material distributor mechanism, generally designated by the reference numeral 19 and to be described in greater detail. Asphalt material deposited by the conveyor means accumulates in a pile in front of the screed, in a relatively narrow area determined by the width of the conveyor means. The distributor mechanism 19 conventionally is in the form of a rotating auger-like device which serves to distribute the paving material 13 laterally outward toward the end extremities of the screed. Conventionally, a paver includes left and right side distributors, arranged to distribute the paving material outward in both directions from the center of the paving machine. In accordance with the present invention, the opposite side distributor mechanisms 19 are telescopically extendable laterally such that, during paving, the length of the distributors may at all times properly correspond with the extended width of the screed 14.

Figure 2:
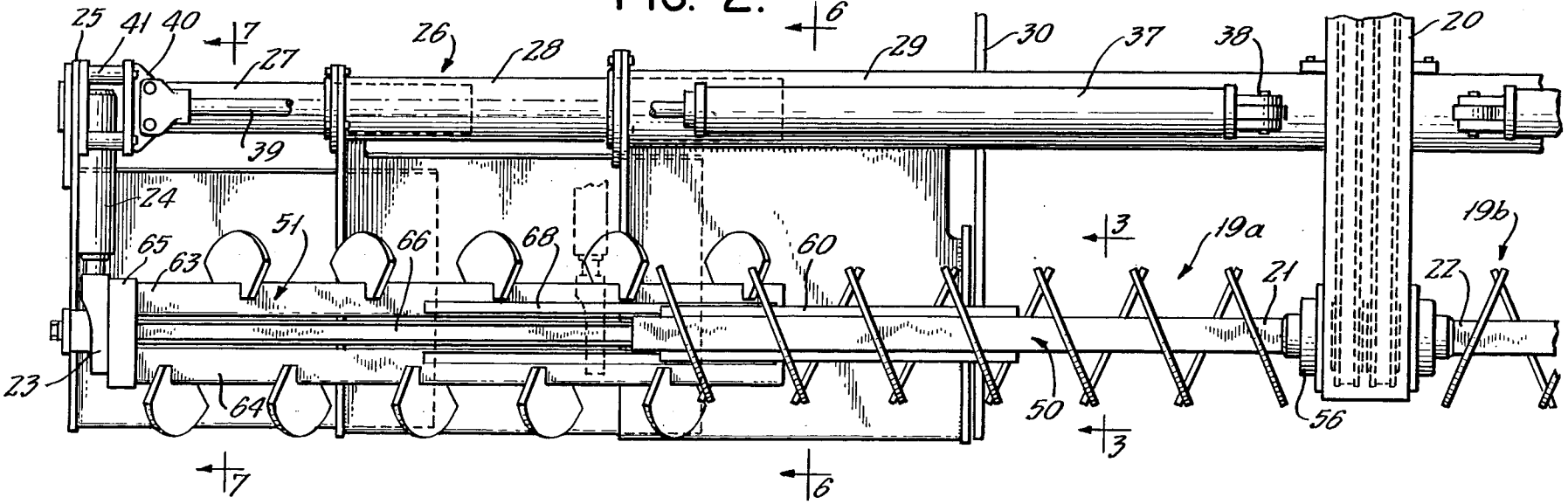
FIG. 2 is an enlarged view illustrating features of construction of the new power extendable distributor mechanism, showing the mechanism in a fully extended condition.

Referring now to FIGS. 2–7, there are shown details of construction of a power extendable distributor mechanism used in the paver apparatus of FIG. 1. As shown in FIG. 2, left and right side distributor assemblies **19*a*, 19*b* are supported and driven, preferrably at the inboard ends, by means of a drive box 20, which is attached to and forms part of the paver tractor. Internally, the drive box 20 includes drive means, typically chains and sprockets etc., for rotating the respective distributor shafts 21, 22, either independently or in unison, depending upon the control facilities provided. In the drawing, details are shown of only the left-hand distributor assembly 19*a***, it being understood, of course, that the complementary, right side distributor is similarly constructed.

Support for the outboard end of the distributor **19*a* is provided by a bearing 23 carried by a vertically adjustable bearing bracket 24 rigidly attached to an outboard support arm 25. The outboard support arm is itself supported by a relatively large diameter, telescoping tube assembly, generally designated by the reference numeral 26**, which in the illustrated apparatus comprises three telescoping tubes, 27, 28 and 29. The inboard tube 29 is mounted at its inner end adjacent the drive box 20 and is supported outboard of the drive box by means of a frame plate 30 forming part of the paver tractor frame.

Figure 10:
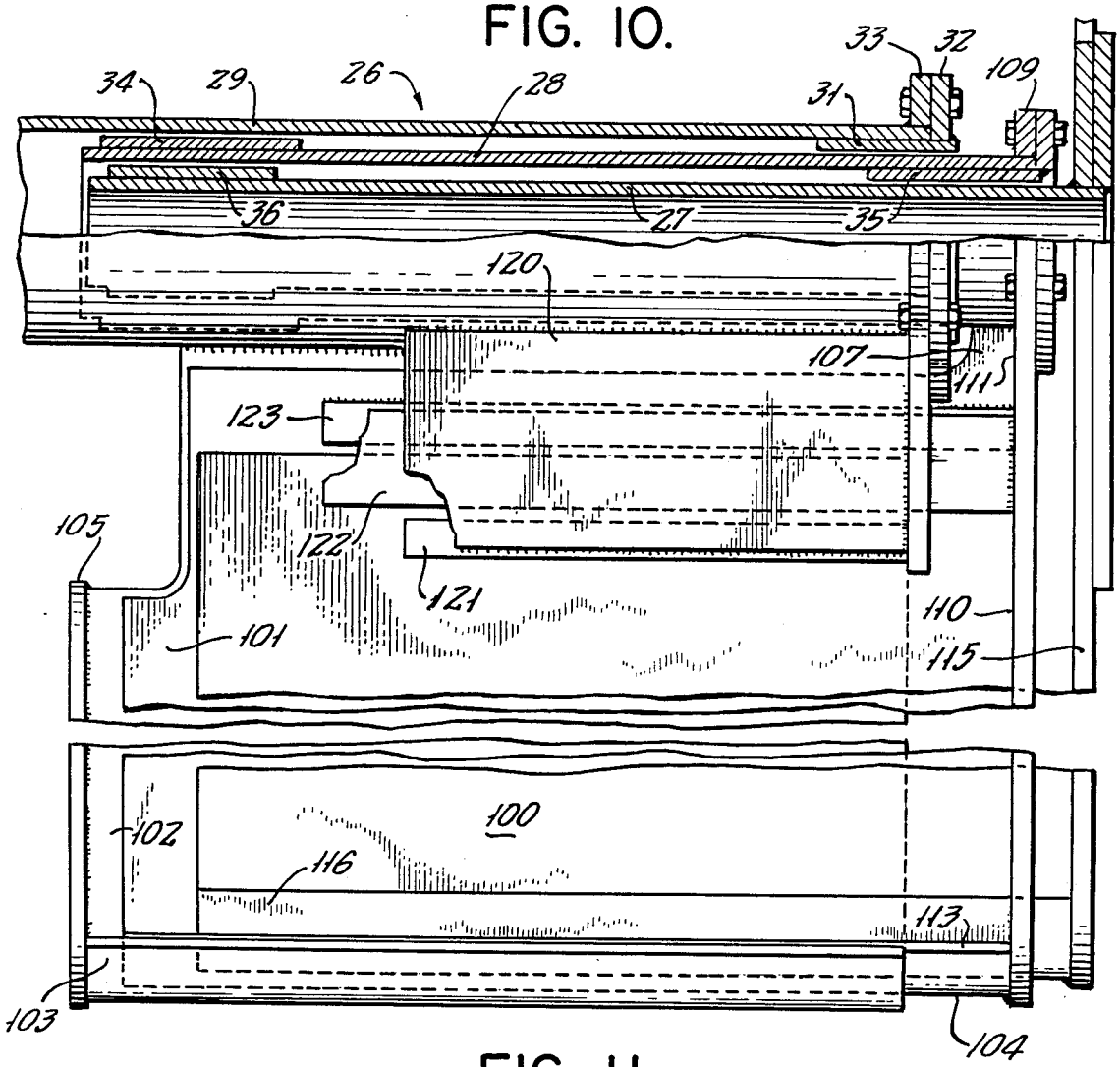
FIG. 10 is a front elevational view of the telescoping panel arrangement, illustrating the confinement panel in its fully retracted condition.

The structure of the telescoping tubes is shown in more detail in FIG. 10. The inboard tube 29 is shown to have an internal collar 31 secured to its open end, by means of an attached flange 32 bolted to a second flange 33 carried at the end of the tube 29. The internal sleeve 31 serves as a slide bearing for the intermediate tube 28, which carries an external sleeve 34 at its inboard end. The sleever 34 serves as a bearing engaging the internal wall of the inboard tube 29. In the illustration of FIG. 10, considerable clearances are shown between the walls of the telescoping tubes and the bearing sleeves, in order to simplify understanding of the drawings. In actual practice, all of these parts will be constructed to have a relatively close sliding fit.

As will be evident in FIG. 10, the respective bearing sleeves 31, 34 will abut against each other when the intermediate tube 28 is extended telescopically to a predetermined limit position.

The intermediate tube 28 is similarly provided at its outboard end with an internal bearing sleeve 35 slideably supporting the outboard tube 27. The latter, at its inboard end, is provided with an external bearing sleeve 36. The respective bearing sleeves 35, 36 function in the same manner as the bearing sleeves 31, 34, providing for a close sliding fit of the telescoping tubes 27, 28 and also serving to provide a limit stop for telescoping extension of the outboard tube 27.

Controlled extension and retraction of the telescoping support 26 is provided by means of a controllable hydraulic cylinder 37 anchored at its inboard end 38 and having an extendable actuator rod 39. The outer end of the actuating rod 39 is attached to the outboard support plate 25, desirably in straddling relation to the adjustable bearing support 24, so as to be substantially aligned therewith. To this end, the actuating rod 39 is attached to a bracket 40, which is bolted to the support plate 25 by a plurality of spacer bolts 41, arranged to straddle the bearing support 24.

In one particularly preferred embodiment of the invention, the rotating distributor mechanism 19*a* includes inboard and outboard telescopically arranged distributor sections 50, 51. The inboard distributor section 50 (see FIGS. 3 and 4) comprises a series of three "square" tubular structural elements 52–54 arranged in side by side relation and secured together by linear welds 55 to form a unitary structure. At its inboard end, this assembly is attached to a drive coupling 56, through which the distributor section is driven from the drive box 20.

Mounted on the outer tube members 52, 54 are a series of deflector plates or paddles 57, alternate ones of which are positioned in staggered relation along the length of the inboard section, rotationally displaced by 180°. These deflector plates are secured to the tube members 52, 54 by welding, as at 58, and typically are in the form of a segment of a disc or circle, covering an angle of approximately 90°. As reflected in FIGS. 3 and 4, the inner portions of the disc segments are removed, and notches 59 are formed in the radially inner portions of the disc segments, such that the structural tube members 52, 54 are partly received therein, providing a highly secure mounting for the deflector plates. When assembled, the deflector segments form diametrically opposed 90° segments of a circular structure, the center of which is coincident with the axis of the center tube member 53, which is also the rotational axis of the distributor assembly.

Extending lengthwise along the inboard distributor section 50, over approximately the outer half thereof, are four drive rails 60 of a triangular cross sectional configuration. One side of the drive rails is seated against a flat supporting surface 61 formed by the deflector segments 57, and the drive rails are secured to the deflector segments as well as to the respective tube members 52, 54 by welding. Each of the drive rails 60 has a radially inwardly facing drive surface 62, and these surfaces, on adjacent drive rails, form a dovetail-like slot arrangement.

Figure 3:
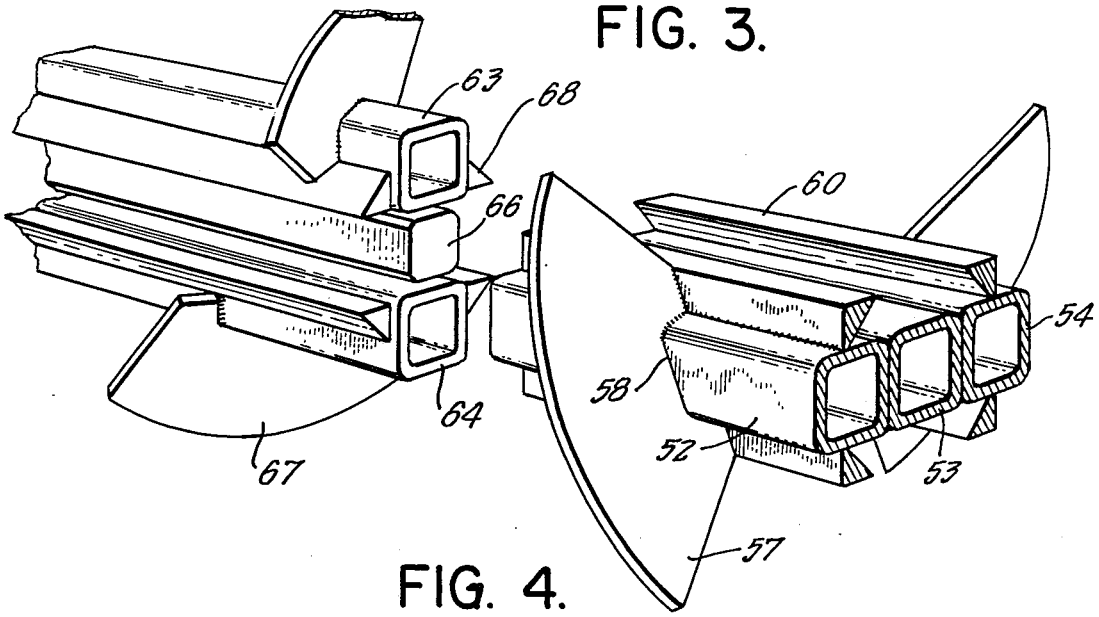
FIG. 3 is an enlarged, fragmentary, exploded view of the distributor mechanism of FIG. 2, illustrating the manner in which the respective sections thereof are telescopically assembled.
Figure 4:
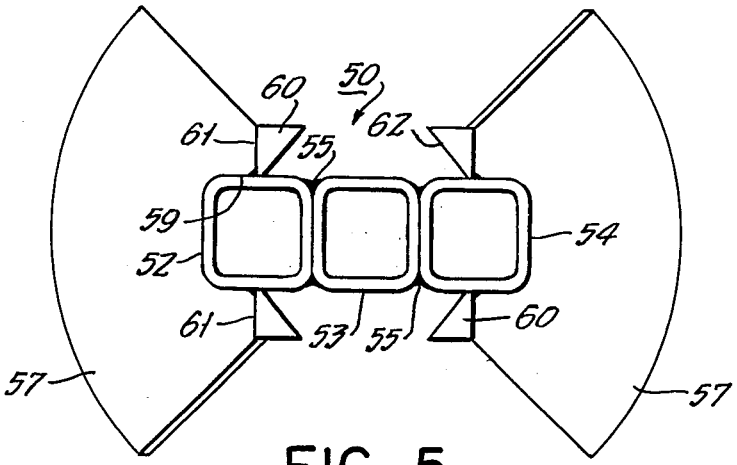
FIGS. 4 and 5 are end elevational views of the respective parts illustrated in the perspective view of FIG. 3.
Figure 5:
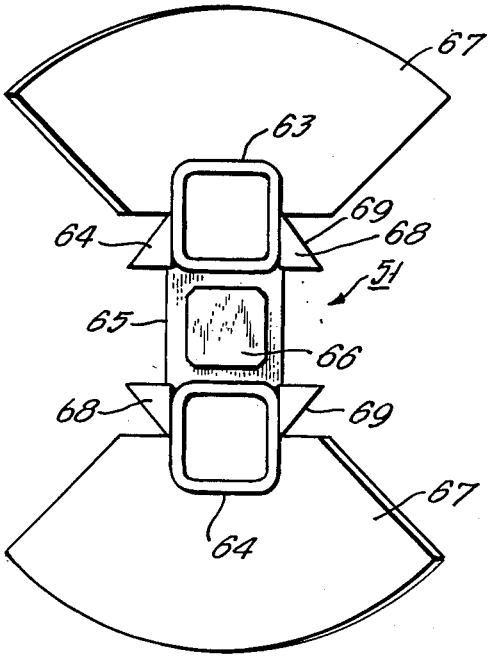

As shown in FIGS. 3 and 5, the outboard distributor section 51 comprises a spaced pair of "square" tubular structural members 63, 64 joined together at their outboard ends by an end cap structure 65. A "square" shaft 66 is secured at its outboard end to the end cap 65 and extends inward, between and in parallel relation to the tubular members 63, 64. The corners of the square shaft 66 have been removed, and the dimensions of the bar are otherwise suitable to be closely received within the interior of the central tubular member 53 of the inboard distributor section 50.

The outboard tubular structural members 63, 64 mount deflector plates 67, which are generally similar to the deflector plates 57 of the inboard distributor section, and are mounted on the tubular members 63, 64 in the same manner as the deflector plates 57 and secured by welding. Pairs of triangular drive rails 68 are welded to the tubular members 63, 64 and extend lengthwise thereof over approximately the inner half of the tubular members (see FIG. 2). The orientation of the drive bar 68 is such that the diagonal surfaces 69 thereof face generally radially outward from the central axis, with adjacent pairs of the drive rails being in the form of dovetail-like elements complementary to the dovetail-like elements formed by adjacent pairs of the drive rails 60.

When the respective inboard and outboard distributor sections are telescopically assembled, the central drive shaft 66 is received internally of the central tube member 53, and the spaced apart tube members 63, 64 of the outboard unit straddle the central tubular member 53 of the inboard unit. As reflected in FIG. 6, the inwardly facing drive rails 60 interfit with the outwardly facing drive rails 68, so that their respective diagonal surfaces are in facing/contacting relation. Because of the dovetail-like configuration, the inwardly facing drive rails serve to confine the outwardly facing drive rails, and thus position and confine the spaced tubular members 63, 64, which are otherwise secured only at their outer end extremities, by the cap member 65.

Figure 6:
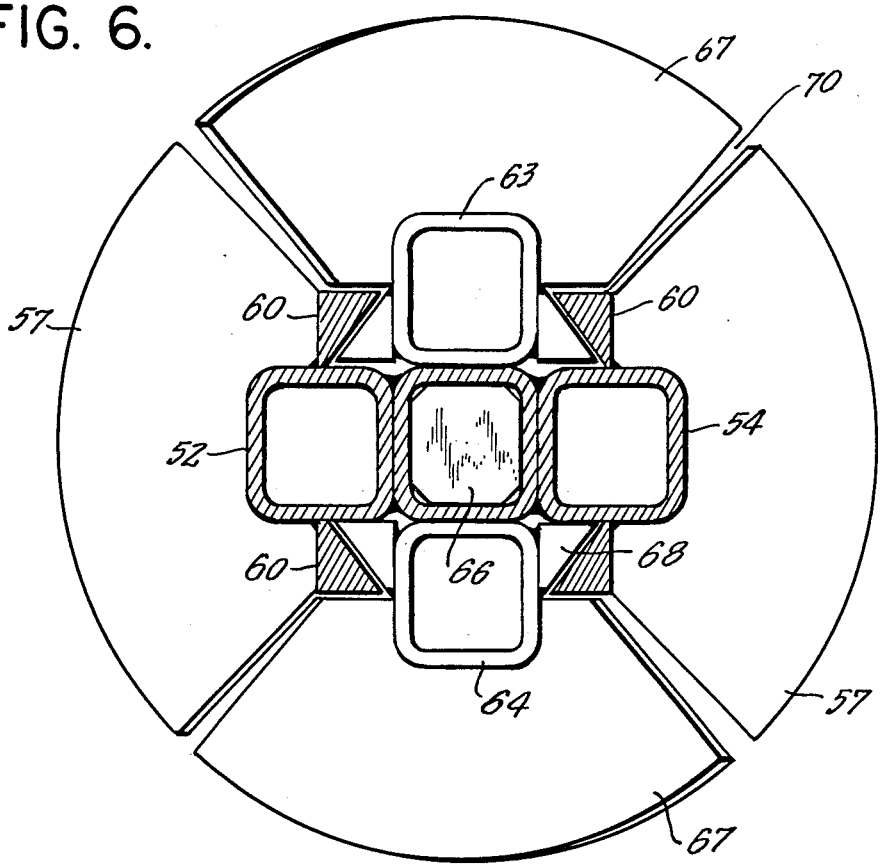
FIG. 6 is a cross sectional view taken on line 6—6 of FIG. 2, illustrating the parts of FIGS. 4 and 5 in an assembled condition.
Figure 7:
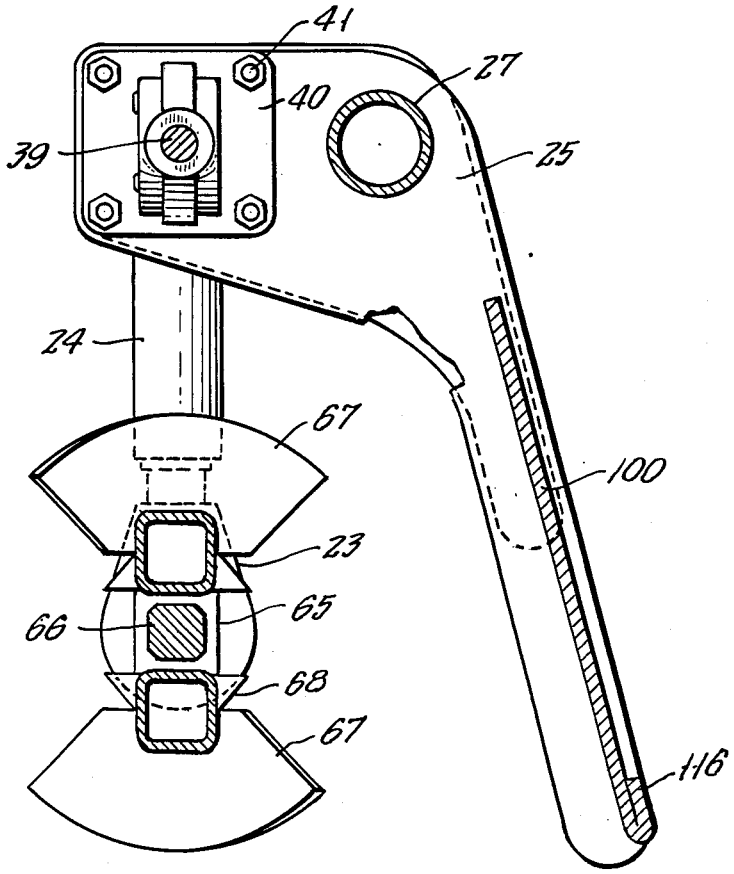
FIG. 7 is a cross sectional view as taken generally on line 7—7 of FIG. 2.

As is also reflected in FIG. 6, the respective inboard and outboard distributor sections mount their opposed sets of deflector plates 57, 67 with a 90° rotational displacement, such that the deflector plates of one section can be received within the open spaces provided by the deflector plates of the other section. Optimally, the sets of deflector plates can be so positioned and arranged on the respective distributor sections that, when the respective inboard and outboard sections are telescoped to a fully retracted or closed condition, the deflector plates generally align themselves in sequence to form a substantially continuous helix. It is by no means necessary to the invention, however, that the plates align themselves in any position to form a substantially continuous helix. To advantage, the respective deflector plates are arranged to provide some degree of clearance space 70 between adjacent deflector edges, whenever two plate are aligned, in order to facilitate one plate passing the other properly during telescopic extending and retracting movements.

As refelected in FIG. 2, the inboard distributor section 50 will, in normal operations of the paver, be driven through the inboard drive cap 56, from the main drive box 20. The rotational motion of the inboard section is transmitted to the outboard section, in any operative position of extension or retraction, in part through the central drive shaft 66 and in part through the pairs of drive rails 60, 68. The central drive shaft 66, transmits torque to the outboard end cap 65, and the cap imparts rotational motion to the outer ends of the outboard tubular structural members 63, 64. Torque is also imparted to the inner portions of the tubular members 63, 64 through the action of the drive rails 60, 68, which cause the otherwise free ends of the tubular members 63, 64 to be confined by and rotationally carried with the tubular members 52–54 of the inboard distributor section. Thus, in any extended or retracted position of the outboard distributor section 51, the latter is driven not only at its outboard extremity, but also over some extended inboard portion, depending upon the degree and location of overlap between the respective sets of drive rails 60, 68.

In general, there is no significant advantage in extending the drive rails over the full length of the respective auger sections. There should be at least several inches of overlap of the rails when the outboard auger section is fully extended, as in the position shown in FIG. 2. It is thus adequate for a similar degree of overlap to be provided when the outboard section is fully retracted. If desired, however, the inboard rail sections 60 may be extended inward further, to provide better confinement of the otherwise free ends of the tubular structural members 63, 64.

Adjustable positioning of the outboard distributor section 51 is accomplished, even during power operation of the distributor, by simply extending or retracting the fluid actuator 37. This serves to extend the outboard distributor section as well as the telescoping tubular support 26, which carries the outboard bearing bracket 24. Typically, separate left side and right side controls will be provided for the opposite side material distributors. These may be operated in unison with or independently of the power extension means for the screed sections 16. Normally, the distributors will be extended or retracted along with the screed extensions 16, but it may be desirable to provide for independent controls so that distributor extension, in relation to screed extension, may be an additional control variable available to the paver operation.

As will be readily appreciated, when the outboard distributor section is extended, there is somewhat less continuity of the deflector plates with the deposited paving material. If necessary or desirable, the rotational speed of the distributor can be varied as a function of its length. Quite typically, however, rotational speed of the distributor is a function of the height of the paving material at or near the outboard end, under the control of a position sensing switch, such that any adjustment in rotational speed is automatically accommodated by the switch itself.

In a typical asphalt paving apparatus, it is advantageous to provide a confinement structure directly in front of the auger-like material distributor devices. The deposited paving material is thus confined in front and behind the auger-like distributor, by means of the panel structure, in front, and the floating screed, in back. In accordance with one aspect of the present invention, a confinement panel structure is provided which extends or retracts along with the material distributor mechanism, such that the paving material is properly confined in any extended or retracted position of the distributor. To particular advantage, the extendable confinement panel structure is mounted on the same telescoping support arrangement that carries the outboard bearing bracket for the extendable distributor mechanism. As will be understood, the extendable confinement panel also serves to provide a safety guard for the front side of the rotating distributor mechanism.

With reference now particularly to FIGS. 1, 2 and 7–10, the variable width confinement panel structure includes outboard, intermediate and inboard confinement panels 100–102, which are carried respectively by the outboard, intermediate inboard telescoping tubes 27–29. The inboard guard panel 102 may be welded across its full top width to the inboard support tube 29 and extends over the exposed outer portion of that tube, from the frame plate 30 to the end flange 32. The lower edge of the panel 102 is bent upward, at 103, to stiffen the panel and to provide a confining channel area 104 (see FIG. 9) for an adjacent panel. Along the inner edge of the confinement panel 102 there is welded a stiffening plate 105, which may be bolted or otherwise secured to the tractor frame plate 30 to rigidify the structure. The flange 33, welded at the outer end of the inboard support tube 29 is provided with a downwardly extending portion 106 (see FIG. 8) providing means for guiding and supporting portions of the adjacent, intermediate panel 101.

Pursuant to the invention, the intermediate panel 101 is secured to the intermediate support tube 28 only by a narrow neck portion 107 adjacent the outer edge of the panel. The inboard portions of the intermediate panels, along its entire upper edge 108 up to the neck portion 107, are recessed as shown in FIG. 8 to provide a clearance underneath the larger diameter inboard support tube 29.

A flange 109, welded to the outer extemity to the intermediate support tube 28, has a portion 110 extending vertically downward for the full height of the intermediate panel. The flange portion 110 is joined with the intermediate panel only in a short region 111 adjacent the neck 107, and again along a narrow area 112 where the lower edge extremity 113 of the intermediate panel is bent upward. Between these two extremities, where the panel 101 is welded to the stiffening flange 110, the latter is recessed (as at 114 in FIG. 9) to slideably receive and guide the outboard panel 100.

The outboard confinement panel is secured only along its outboard vertical edge, where it is welded to a downward extension 115 of the outboard support arm 25. In the illustrated arrangement, the lower edge extremity 116 of the outboard panel is folded over flat against the main surface of the panel forming a stiffening rib, which is received in an enlargement 117 of the recess 114 in the intermediate arm extension 110. As reflected particularly in FIGS. 8 and 9, the bent-around lower end portions 103, 113 and 116 of the respective confinement panels 102, 101 100 serve dual purposes. First, they stiffen and strengthen the lower end portions of the panels. Second, each provides a guide and confinement for the other to accommodate telescoping extending and retracting movements. Thus, the free lower portion of the intermediate panel 101 is confined by the cooperative relationship between the upwardly bent lip portions 103, 113. The otherwise free inner portion of the outboard panel 100 is guided and confined by the upwardly bent portion 113. The folded-over portion 116 of the outboard panel serves to provide an increased bearing area and also provides structural stiffening.

Figure 9:
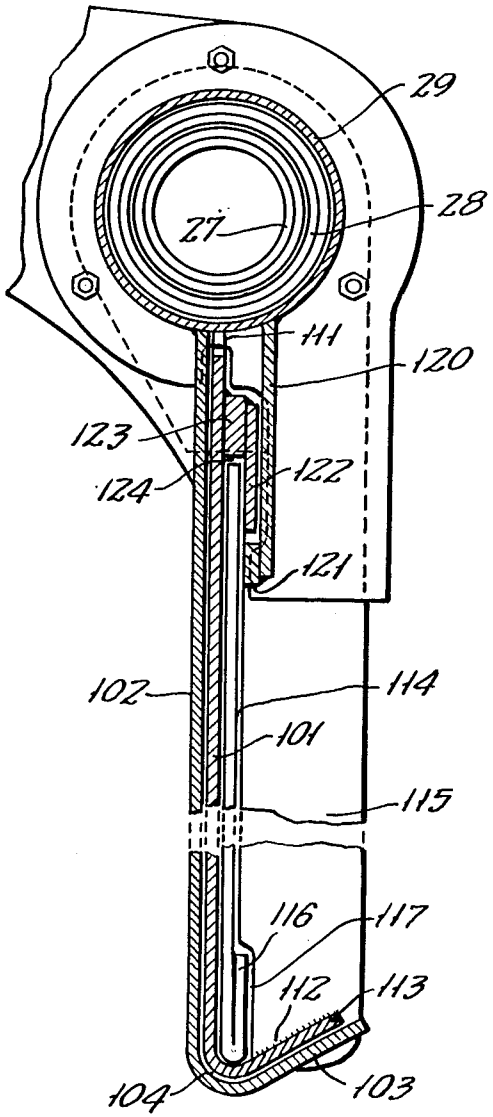
FIG. 9 is an enlarged cross sectional view as taken generally on line 9—9 of FIG. 8.
Figure 8:
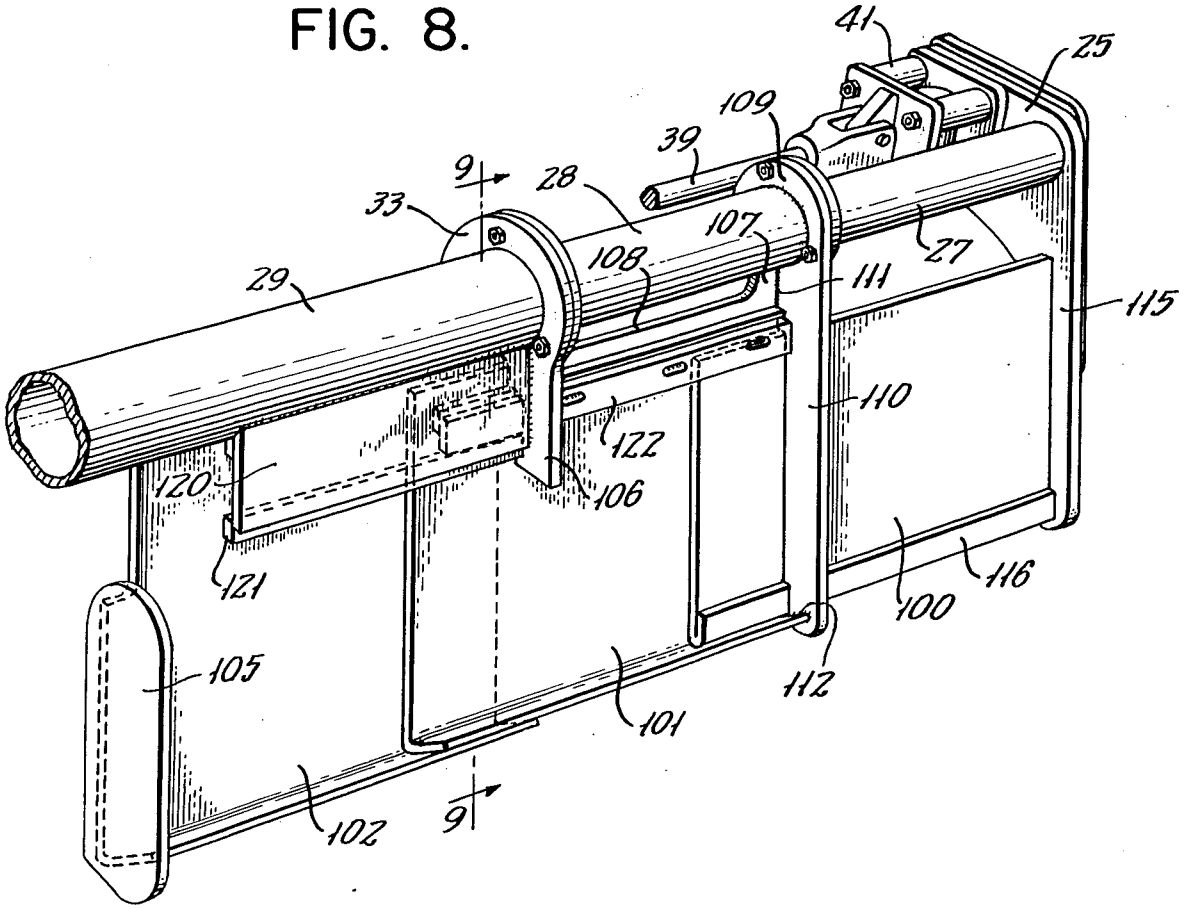
FIG. 8 is a fragmentary perspective view of a telescoping confinement panel structure for use in connection with the telescoping distributor arrangement.

To guide and confine the free upper, inboard portion of the intermediate panel 101, an arrangement of guide bars is provided, which is shown particularly in FIGS. 8 and 9. These are shown in the illustration with substantial clearances, in order to facilitate an understanding of the structure. In the actual device the parts will be constructed to provide reasonably close sliding fits.

Welded to the inboard support tube 29 is a first guide housing plate 120, which is welded along its top edge to the tube 29 and along its outboard edge to the support flange 106. The housing plate 120 is parallel to but spaced forward of the fixed, inboard confinement plate 102. Welded to the lower margin of the housing plate 120, along its inside lower edge, is a guide bar 121.

An intermediate guide bar 122 is welded to the intermediate guard plate 101 through an interposed spacer bar 123 which in turn is welded directly to the surface of the intermediate panel. As shown in FIG. 9, the upper portion of the intermediate panel 101 is confined on the back side by the fixed inboard panel and on the front side by the cooperation of the front surface of the guide bar 122 with the back surface of the housing plate 120. The confronting surfaces of the respective guide bars 121, 122 serve to provide vertical support for the intermediate plate.

As shown in FIG. 9, the guide bar 122 extends downward, substantially below the lower edge of the spacer bar 123, providing a downwardly opening guide slot 124 adapted to receive the upper edge margin of the outboard confinement panel 100.

The extendable confinement panel structure is shown in FIG. 8 in a fully extended condition and in FIG. 10 in a fully retracted condition. The construction of the extendable panel is simple and effective, yet extremely rugged and suitable for the heavy duty service to which equipment of this type is subjected. It is not intended, of course, that the extendable confinement panel structure function as a screed or strike-off, but it nevertheless must be capable of withstanding relatively severe abuse because of the nature of the intended service.

In the illustrated form of the invention, the extendable confinement panel is effectively an integral part of the power extendable distributor structure. However, it will be understood that, if appropriate, the power extendable panel arrangement might be utilized to advantage even with a conventional paver device such as the type utilizing movable auger means mounted on a variable width strike-off, for example, or even for use where bolt-on auger extensions are used. In either case, the use of a power extendable confinement panel would minimize opportunities for job-site workmen to create an unsuitable operating condidition by reason of their failure to bolt on a panel extension, for example, when attaching a distributor extension.

Figure 11:
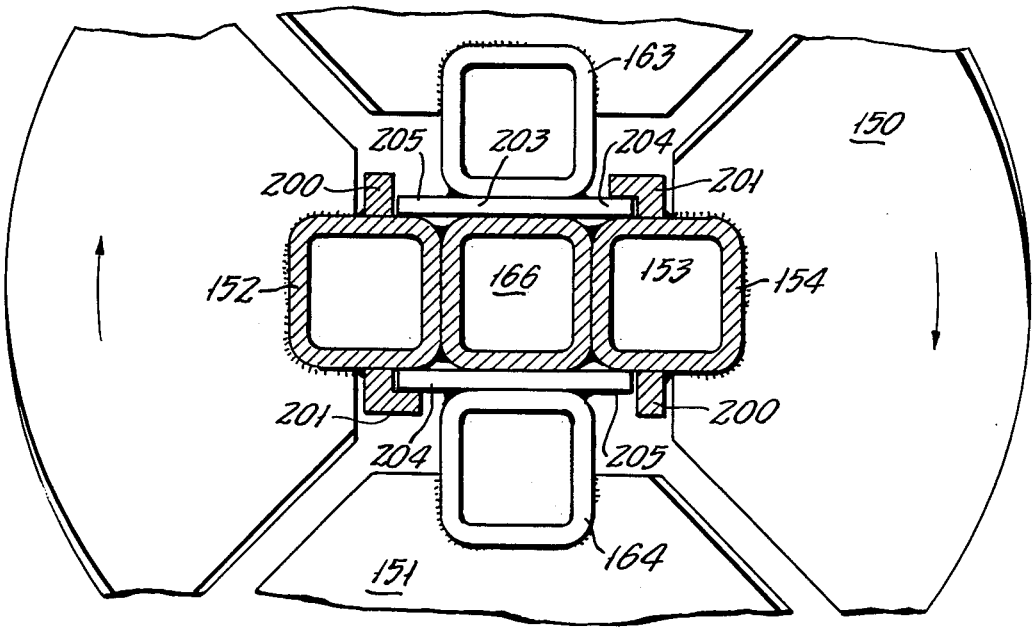
FIG. 11 is an enlarged, fragmentary cross sectional view of a modified form of power extendable distributor arrangement suitable for use in the paver of FIG. 1.

In a modification of the power extendable material distributor mechanism of the invention, shown in FIG. 11 of the drawing, the inboard and outboard auger-like distributor sections are constructed with a different form of drive rail configuration. In the FIG. 11 version, the inboard section includes three structural tubular members 152–154 welded together in a common plane and otherwise constructed in a manner similar to the inboard distributor section 50 previously described. In place of the drive rails 60 of triangular cross sectional configuration, however, the FIG. 11 modification employs a single guide bar 200 on the forward-rotating side of each of the tubular members 152, 154, and an L-shaped guide bar 201 on the trailing side of those tubular members (assuming a clockwise direction of rotation as viewed in FIG. 11).

The outboard distributor section 151 comprises a spaced pair of tubular structural members 163, 164 corresponding generally to the members 63, 64 of the first described embodiment. In place of the drive rails 68 of triangular configuration, however, the tubular members 163, 164 have welded to their inside surfaces elongated drive plates 203 which extend lengthwise of the distributor section and have leading and trailing edge margins 204, 205 projecting laterally beyond the side edges of the tubular members.

When the distributor structure of FIG. 11 is rotated in a clockwise direction, the tubular members 152, 154 of the driven inboard section will "push" against the plate margins 205, while the L-shaped drive rails 201 will "pull" on the exposed plate margins 204, to impart the necessary drive torque to the inboard portions of the outer auger section. The outer extremity of the outboard section is of course driven by means of the central "square" bar 166 in the same manner as the previously described embodiment.

The drive rail arrangement of the FIG. 11 embodiment is somewhat simpler and less expensive to construct than the arrangement of the principal described embodiment, although the latter is perhaps functionally superior.

Figure 14:
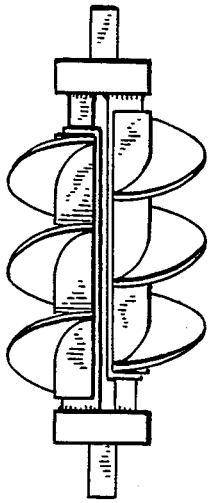
FIGS. 12–14 are illustrations of a second modified form of power extendable distributor structure incorporating principles of the invention, FIGS. 12 and 14 illustrating the meachnism in extended and retracted positions respectively, and FIG. 13 representing a cross sectional view taken generally on line 13—13 of FIG. 12.
Figure 12:
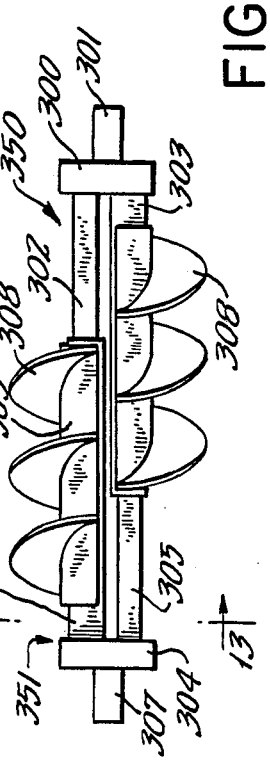
Figure 13:
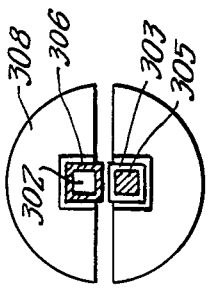

In the modifications of FIGS. 12–14, a power extendable distributor arrangement is provided in which deflector plates cover an arcuate segment of approximately 180°. Accordingly, all of the segments of one orientation are mounted on the outboard distributor section, while all of the plates of the opposite orientation are mounted on the inboard distributor section. An end cap structure 300 is provided, having a shaft projection 301 for attachment to the drive box mechanism 20 of the paver. From one side of the inboard end cap 30 projects an internal bar or shaft 302 while on the opposite side of the axis there extends a hollow tubular member 303.

The outboard distributor section 351 is substantially a mirror image of the inboard section 350, having an outboard end cap 304 mounting in parallel relation a bar or shaft 305 and a tubular structural member 306. A shaft projection 307 is arranged for reception in the outboard bearing member of the basic apparatus as heretofore described. Each of the bar members 302, 305 is telescopically received within the tubular member 306, 303 of the opposite distributor section.

Welded or otherwise secured to the respective tubular members 303, 306 are a series of semicircular helical segments 308 which, in the illustrated arrangement, are provided with spacer sleeves 309. Thus, depending on the overall length of the respective distributor sections, a plurality of semicircular paddle-like deflector segments may be welded along the length of the tubular members to provide "semi helix". In the position of full retraction of the distributor mechanism, as shown in FIG. 14, the structure is substantially equivalent to a conventional auger, with helix-like material deflector means. In the fully extended position, shown in FIG. 12, the half sections are functional at the inboard and outboard extremes, and there typically is some overlap of auger segments in the intermediate section.

Figure 15:
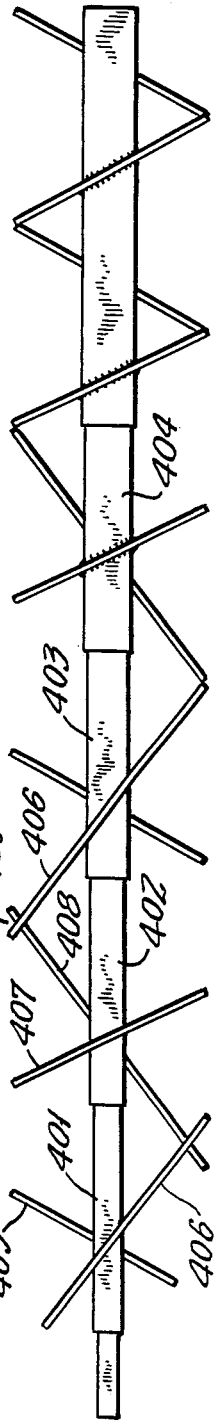
FIGS. 15–17 are illustrations of a still further modified form of telescoping, power extendable distributor arrangement, with FIGS. 15 and 17 showing the distributor in extended and retracted conditions respectively, and FIG. 16 representing an end elevational view thereof.
Figure 17:
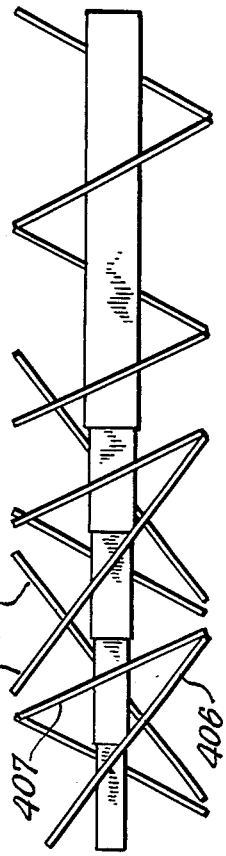
Figure 16:
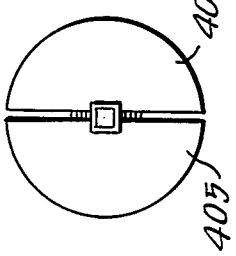

In the further modification of FIGS. 15–17, there is shown a form of telescopically extendable distributor in which the individual deflector plate segments 405–409 are of semicircular projected configuration (FIG. 16) and in which each of several telescoping segments 401–404 contains two such 180° segments, one disposed at a relatively large acute angle to the shaft axis, and the other being disposed at a relatively smaller acute angle. The arrangement is such that, when the telescoping sections are extended, there is functional overlap between adjacent 180° sections that are disposed at the smaller angle to the auger axis. By functional overlap, it is meant that the auger segments are either physically overlapped as shown in FIG. 15, or if not physically overlapped, at least sufficiently close together that paving material is transferred from one auger section to the next and thus is effectively continuously advanced outwardly by rotation of the auger mechanism.

In the modification of FIG. 15, the large angle/small angle arrangement of the plate segments of each pair is alternated in successive telescoping sections. Accordingly, when the structure is partially or fully retracted, the low angle, 180° segments can pass each other without interfering. A condition of full retraction is achieved when the large angle segment of one telescoping section approaches the low angle segment of the adjacent telescoping section, substantially as reflected in FIG. 17.

Figure 19:
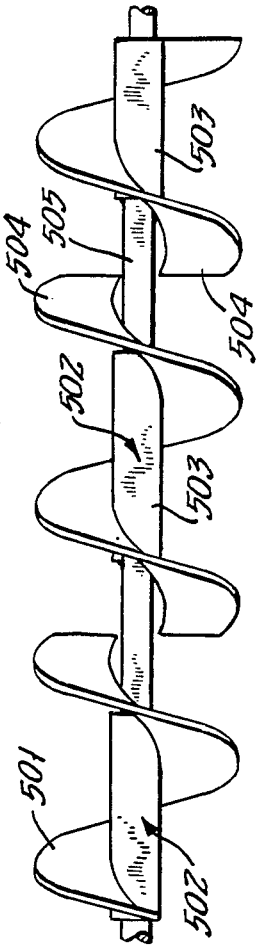
FIGS. 18 and 19 are illustrations of a still further modified form of power extendable distributor mechanism according to the invention, illustrating the distributor mechanism in extended and retracted conditions respectively.
Figure 18:
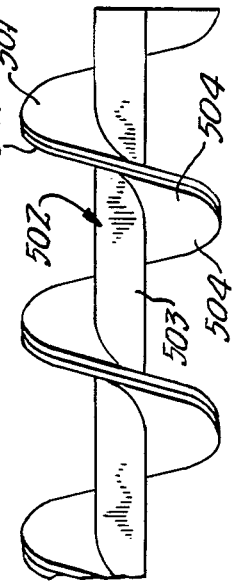

In the modification of FIGS. 18 and 19, continuous helix sections 501 are provided which, in the extended configuration of the distributor mechanism, form a continuous or almost continuous helix. In the condensed or retracted configuration of the distributor, each of a plurality of distributor sections 502 is spirally retracted upon an adjacent section, providing a generally continuous helix of double thickness, as shown in FIG. 18. To this end, each of the illustrated distributor segments 501 consists of approximately 720° of spiral. The middle 360° portion is secured, as by welding, to a tubular sleeve section 503, while a 180° portion 504 on each end is supported in cantilever fashion. Each segment has a shaft portion 504, which telescopes into the adjacent tubular section 503. When the assembly is retracted, the adjacent sections are rotated and telescopically condensed with a helical movement. The cantilever supported helix sections slide one behind the other and "wind" themselves over the adjacent tubular sections 502.

The apparatus of the invention represents a significant advance in the construction of material distributor mechanisms, for asphalt paving machines in particular, because of the active need and desirability for variable width paving and/or the need or desirability of power extendable/retractable paving equipment, giving the equipment the capability of occasional utilization for variable width paving requirements. Heretofore, variable width paving has been accomplished principally with the use of power extendable screed and strike-off arrangements. The previously known equipment, while far superior to conventional fixed width equipment, nevertheless has suffered from the disadvantage that the guard-like material distribution facility has not been extendable and retractable along with the screed. One previous attempt to deal with this shortcoming, the Fisher et al. U.S. Pat. No. 3,097,451, falls far short of achieving such a purpose. First, there in fact is no provision for extending or retracting the auger-like distributor. Rather, the auger is merely repositioned so as to cooperate with the outboard areas of the screed or strike-off. This tends to satisfy one need at the expense of another (the center area). Additionally, the movable auger arrangement is mounted on the screed or strike-off itself, such that the significant and highly variable reaction forces on the auger are necessarily imparted to the screed, having a potentially undesirable effect upon the smoothness of the pavement mat.

In the preferred form of the applicant's invention, the power extendable distributor mechanism is mounted directly by the paver tractor, and not by the screed. Thus, the screed is isolated from both the weight and the reaction forces of the auger. Additionally, separate mounting of the extendable distributor mechanism allows for independent control of distributor extension vis-a-vis screed extension, so that an additional control capability is available to the paver operator.

In a highly advantageous form of the invention, a telescoping cantilever support structure, which provides outboard bearing support for the rotating, extendable material distribution device, also mounts a telescoping panel structure providing a material confinement means on the front side of the distributor. The panel structure is formed of a plurality of overlapping, flat panels, carried by the telescoping members of the bearing support, and extendable and retractable along with the material distribution device.

The structure of the invention greatly enhances the performance of paving equipment with power extendable screed facilitates by assuring that the lateral distribution of paving material will always be properly related to the extended width of the screed.

It should be understood of course that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. For use in combination with an asphalt paver or the like, a telescopically extendable auger-like material distribution apparatus for effecting lateral distribution of paving material, which comprises (a) an inboard material distribution section, and an outboard material distribution section telescopically extendable and retractable relative to said inboard section, (b) mounting means for rotatably mounting the inboard end of said inboard material distribution section on said paver or the like, (c) said outboard section being drivingly connected to said inboard section for rotation in unison, (d) a telescoping cantilever bearing support means supported on said mounting means and extending laterally outward adjacent said material distribution sections.

(e) said bearing support including at least one telescopically extendable and retractable outboard section, (f) bearing means carried by said extendable bearing support and rotatably supporting outer portions of said outboard outboard section, (g) controllable power means for effecting on-the-fly extending and retracting movements of said outboard bearing support and said outboard material distribution section during paving, (h) each of said respective inboard and outboard material distribution sections having cooperative angularly disposed deflector plate means arranged over its effective length for distributing paving material laterally upon rotation, (i) said deflector plate means on the respective inboard and outboard material distribution sections being cooperatively associated to accommodate relative axial overlapping movements of said deflector plate means during telescoping movements of said sections.

2. The material distribution apparatus of claim 1, further characterized by (a) a telescopically extendable confinement panel structure mounted on said bearing support means and extending downward therefrom in front of said distribution means, (b) said panel structure comprising a plurality of overlapping, slideably related panels positioned adjacent said mounting distribution means and adapted for on-the-fly extending and retracting movements therewith.

3. The material distribution apparatus of claim 2, further characterized by (a) said apparatus including a floating screed mounted independently of said material distribution means, in trailing relation thereto and being adapted for on-thefly lateral adjustment, (b) said confinement panel structure being positioned in leading relation to said material distribution means.

4. A telescopically extendable material distribution apparatus according to claim 1, further characterized by (a) said inboard and outboard material distribution sections being non-rotatably connected, (b) said deflector plate means comprising paddle-like plate segments extending over an arc of less than 360 degrees, and (c) the plate segments of one section being complementary with the plate sections of the other section, whereby the deflector plates of one section pass deflector plates of the other section telescopic movement of one section relative to the other.

5. In a paving apparatus or the like adapted for movement along a roadbed for laying of a mat of paving material and of the type having an auger-like material distribution means for distribution said paving material laterally, the improvement in said material distribution means which comprises (a) a telescopically extendable member including an inboard material distribution section and at least one outboard material distribution section telescopically extendable and retractable relative to said inboard section, (b) said inboard and outboard material distribution sections each having cooperating elements thereon for distributing paving material laterally, (c) means rotatably mounting one end of a first one of said material distribution sections for rotatably driving said first section, (d) the second of said material distribution sections being drivingly connected to said first section for rotation in unison, (e) a telescoping bearing support means mounted by said paving apparatus and extending laterally outward adjacent said material distribution sections, (f) said bearing support including at least one telescopically extendable and retractable outboard section, (g) bearing means carried by said extendable bearing support and rotatably supporting outer portions of said outboard material distribution section, (h) said telescopically extendable material distribution means and said telescoping bearing support means being adapted for relatively free telescoping movement during normal paving operations, and (i) controllable power means for effecting on-the-fly extending and retracting movements of said outboard bearing support and said outboard material distribution section during paving operations of said paving apparatus.

6. An asphalt paving apparatus or the like comprising (a) movable means for depositing paving material on a roadbed, (b) laterally power extendable and retractable floating screed means towed by said movable means for distributing paving material laterally and adapted for on-the-fly extending and retracting movements during paving, and (c) laterally power elongatable and contractable material distribution means positioned in front of said screed means and adapted for on-the-fly elongating and contracting movements during paving.

7. In an asphalt paving apparatus or the like of the type having movable means for receiving paving material and depositing said material on a roadbed, variable width floating screed means connected to said movable means at predetermined tow points, and auger-like material distribution means mounted on said tractor directly in front of said screed for distributing paving material laterally in front of said screed, the improvement in said auger-like material distribution means which comprises (a) an on-the-fly telescopically extendable auger-like material distribution member including an inboard section, and an outboard section telescopically extendable and retractable relative to said inboard section, (b) means rotatably mounting the inboard end of said inboard section on said movable means, (c) said outboard section being drivingly connected to said inboard section for rotation in unison, (d) means for rotating at least one of said sections, (e) telescoping cantilever bearing support means mounted on said movable means and extending laterally outward adjacent said material distribution member, (f) said bearing support including at least one on-the-fly extendable and retractable outboard section, (g) bearing means carried by said extendable bearing support and rotatably supporting outer portions of said outboard section, and (h) controllable power means for effecting on-the-fly extending and retracting movements of said outboard bearing support and said outboard material distribution section during paving operations, (i) said respective inboard and outboard material distribution sections having cooperative angularly disposed deflector plate means for distributing paving material laterally upon rotation, (j) said deflector plate means on the respective inboard and outboard sections being cooperatively associated to accommodate relative axial overlapping of said plate means upon telescopic movement of said auger sections to a relatively retracted configuration.

8. A paving apparatus according to claim 7, further characterized by (a) said inboard and outboard sections being non-rotatably connected, (b) said deflector plate means comprising arcuate plate segments extending over an arc of less than 360 degrees, and (c) the plate segments of one section being complementary with the plate sections of the other, whereby the deflector plates of one section pass deflector plates of the other section upon telescopic movement of one material distribution section relative to the other.

9. An asphalt paver according to claim 7, further characterized by (a) telescopically extendable and retractable material confinement panel means mounted on said bearing support means and extending downward in front of said material distribution member, (b) said panel means comprising a plurality of slideably related panels, mounted on respective ones of the telescoping bearing support sections.

10. A paving apparatus according to claim 7, further characterized by (a) said variable width screed and said material distribution sections being independently extendable and retractable during paving.

11. A paving apparatus according to claim 10, further characterized by (a) said bearing support means being structurally independent of said screed and movable independently thereof.

12. In a paving apparatus of the type having a variable width screed means adjustable during paving and auger-like material distribution means mounted in front of said screed for distributing paving material laterally in front of said screed, the improvement in said material distribution means which comprises (a) a telescopically extendable auger-like material distribution member including an inboard section and at least one outboard section telescopically extendable and retractable relative to said inboard section, (b) means rotatably mounting the inboard end of said inboard auger section, (c) said outboard section being drivingly connected to said inboard section for rotation in unison, (d) a telescoping bearing support means mounted on said paving apparatus and extending laterally outward adjacent said material distribution sections, (e) said bearing support including at least one telescopically extendable and retractable outboard section, (f) bearing means carried by said extendable bearing support and rotatably supporting outer portions of said outboard material distribution section, and (g) controllable power means, operable during paving, for extending and retracting said outboard bearing support and material distribution section while said paving apparatus is in motion, (h) said material distribution member being adjustable independently of said screed means.

13. The improvement of claim 12, further characterized (a) said material distribution member having a single inboard section and a single outboard section, (b) a first of said sections including a center shaft member drivingly connected to the second section, (c) an end member for said first section driven by said center shaft member and mounting in cantilever fashion a pair of longitudinally extending structural members arranged in straddling relation to portions of said second section, (d) cooperating drive means on said second section and on said structural members for telescopically and drivingly engaging the free end portions of said structural members.

14. The improvement of claim 12, further characterized by (a) material confinement panel means positioned in front of at least outboard portions of said material distribution means, (b) said confinement panel means comprising at least one movable panel member carried by said bearing support and movable therewith, (c) said confinement panel means extending downward from said bearing support toward the surface being paved.

15. A telescoping panel structure, especially for use on an asphalt paver or the like having a power extendable material distribution means extendable and retractable during paving, which comprises (a) a telescoping support arm comprising an inboard section fixed to said paver and extending outward therefrom and at least one movable outboard support section, (b) a fixed panel mounted on and extending downward from said inboard support section in front of said material distribution means, (c) a movable panel mounted on and extending downward from said outboard support section, and (d) cooperating guide means on the respective panels operative to confine said movable panel relative to said fixed panel while accommodating relative sliding movement of said panels.

16. A telescoping structure according to claim 15, further characterized by (a) said inboard support section being of tubular construction and said outboard support section being received internally thereof, (b) said movable panel being secured to the outer end extremities of said outboard support section in a limited outboard region only of said panel, (c) the upper edge area of said movable panel being recessed to receive said inboard support section when said outboard section is telescopically retracted within said inboard section.

17. A telescoping panel structure according to claim 16, further characterized by (a) said fixed panel having its lower edge margin bent in the direction of said movable panel and then upward to form a guide trough for the lower portion of said movable panel.

18. A telescoping panel structure according to claim 15, further characterized by (a) bearing support means being carried by said outboard support section, (b) said panel structure comprising means for the confinement of paving material in front of said power extendable material distribution means, (c) the outboard end of said power extendable material distribution means being supported by said bearing support, whereby said material distribution means and said material confinement panel means are extended and retracted in unison.

19. A telescopically extendable auger-like material distribution device for pavers and the like which comprises, (a) at least one inboard material distribution section, (b) at least one outboard material distribution section telescopically associated with said inboard section, (c) deflector plate means carried by each of said material distribution sections, (d) the deflector plate means of each material distribution section being so related to the deflector plate means of an adjacent section as to provide a laterally distributed deflector plate configuration in any extended or retracted position of said material distribution sections, (e) said device comprising at least two adjacent, telescopically associated material distribution sections, (f) one of said adjacent sections mounting a plurality of deflector plates oriented 180° apart, (g) the other of said adjacent sections mounting deflector plates oriented 90° apart from said first mentioned deflector plates.

20. The telescopically extending material distribution device of claim 19, further characterized (a) said auger member having a single inboard section and a single outboard section, (b) one of said sections including a center shaft member drivingly connected to the other of said sections, (c) an end member mounted on said shaft member and mounting in cantilever fashion a pair of axially extending structural members arranged in straddling relation to portions of said other section, (d) cooperating drive means on said other section and on said structural members for telescopically and drivingly engaging the free inner end portions of said structural members.

21. In a paving apparatus or the like of the type having movable means for receiving paving material and depositing said material on a roadbed, variable width floating screed means connected to said movable means at predetermined tow points, and auger-like material distribution means mounted on said tractor directly in front of said screed for distributing paving material laterally in front of said screed, the improvement in said auger-like material distribution means which comprises (a) a telescopically extendable auger-like material distribution member including an inboard section, and an outboard section telescopically extendable and retractable relative to said inboard section, (b) means rotatably mounting the inboard end of said inboard section on said movable means, (c) said outboard section being drivingly connected to said inboard section for rotation in unison, (d) means for rotating at least one of said sections, (e) telescoping cantilever bearing support means mounted on said movable means and extending laterally outward adjacent said material distribution member, (f) said bearing support including at least on extendable and retractable outboard section, (g) bearing means carried by said extendable bearing support and rotatably supporting outer portions of said outboard section, and (h) controllable power means for extending and retracting said outboard bearing support and said outboard material distribution section, (i) said respective inboard and outboard material distribution sections having cooperative angularly disposed deflector plate means for distributing paving material laterally upon rotation, (j) said deflector plate means on the respective inboard and outboard sections being cooperatively associated to accommodate relative telescopic movement of said auger sections, (k) said inboard and outboard sections being non-rotatably connected, (l) said deflector plate means comprising arcuate plate segments extending over an arc of less than 360 degrees, and (m) the plate segments of one section being complementary with the plate sections of the other, whereby the deflector plates of one section pass deflector plates of the other section upon telescopic movement of one material distribution section relative to the other, (n) said deflector plates covering arcuate sectors of approximately 90 degrees, and (o) alternate ones of said deflector plates on the same auger member being displaced by aproximately 180 degrees.

22. In a paving apparatus of the type having a variable width screed means and auger-like material distribution means mounted in front of said screed for distributing paving material laterally in front of said screed, the improvement in said material distribution means which comprises (a) a telescopically extendable auger-like material distribution member including an inboard section and at least one outboard section telescopically extendable and retractable relative to said inboard section, (b) means rotatably mounting the inboard end of said inboard auger section, (c) said outboard section being drivingly connected to said inboard section for rotation in unison, (d) a telescoping bearing support means mounted on said paving apparatus and extending laterally outward adjacent said material distribution sections, (e) said bearing support including at least one telescopically extendable and retractable outboard section, (f) bearing means carried by said extendable bearing support and rotatably supporting outer portions of said outboard material distribution section, and (g) controllable power means for extending and retracting said outboard bearing support and material distribution section, (h) said material distribution member having a single inboard section and a single outboard section, (i) a first of said sections including a center shaft member drivingly connected to the second section, (j) an end member for said first section driven by said center shaft member and mounting in cantilever fashion a pair of longitudinally extending structural members arranged in straddling relation to portions of said second section, (k) cooperating drive means on said second section and on said structural members for telescopically and drivingly engaging the free end portions of said structural members, (l) said second material distribution section comprising a series of three elongated tubular structural members secured in side-by-side relation, (m) a plurality of spaced first deflector plate segments radially mounted on the outer ones of said structural members and extending over arcuate segments of not more than approximately 90°, (n) said first material distribution section comprising a central shaft, telescopcially received within and drivingly engaged by the central structural member of said second section, (o) said first section further including a pair of spaced apart tubular structural members mounted in cantilever fashion to the outboard end of said central shaft and positioned in closely straddling relation to said central structural member between the sets of first deflector plate segments, (p) sets of second deflector plates segments mounted on said spaced apart tubular members, in the arcuate regions between the plates of said first set to accommodate relative movement of the respective sets of deflector plate, one past the other, and (q) secondary drive means on said second section engageable with free end portions of the spaced structural members of said outboard section for confining said free end portions.

23. The improvement of claim 22, further characterized by (a) said secondary drive means comprising pairs of elongated drive elements mounted on certain structural members of one material distribution section for slideable engagement with cooperative elongated drive elements mounted on structural members of the other material distribution section.

24. The improvement of claim 23, further characterized by (a) adjacent pairs of said rail-like elements forming dovetail-like connecting means for both driving and confining free end portions of said spaced structural members.

25. An asphalt paving apparatus or the like comprising (a) movable means for depositing paving material on a roadbed, (b) laterally power extendable and retractable floating screed means towed by said movable means for distributing paving material laterally and adapted for on-the-fly extending and retracting movements during paving, and (c) laterally power extendable and retractable material distribution means positioned in front of said screed means and adapted for on-the-fly extending and retracting movements during paving, (d) said power extendable and retractable material distribution means comprising a rotating auger-like members, (e) said auger-like member including a fixed inboard section and at least one laterally movable outboard section, (f) said inboard and outboard sections having deflecting plates thereon arranged to be axially overlapped in retracted positions of said material distribution means.

26. An asphalt paving apparatus according to claim 25, further characterized by (a) a telescoping cantilever support arm mounted on said movable means and adjustable during paving, and (b) an outboard bearing support carried by said telescoping cantilever support arm for rotatably supporting outer portions of said laterally movable material distribution section.

* * * * *